US009551952B1

(12) United States Patent
Hong et al.

(10) Patent No.: US 9,551,952 B1
(45) Date of Patent: Jan. 24, 2017

(54) IMAGE FORMING APPARATUS AND METHOD FOR CONTROLLING CHARGING THEREOF

(71) Applicant: SAMSUNG ELECTRONICS CO., LTD., Suwon-si, Gyeonggi-do (KR)

(72) Inventors: Jin-man Hong, Suwon-si (KR); Jae-bum Yoo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/073,083

(22) Filed: Mar. 17, 2016

(30) Foreign Application Priority Data

Sep. 17, 2015 (KR) ..... 10-2015-0131774

(51) Int. Cl.
*G03G 15/02* (2006.01)

(52) U.S. Cl.
CPC ..... *G03G 15/0283* (2013.01)

(58) Field of Classification Search
USPC ..... 399/38, 42, 44, 50, 115, 168, 174, 176
See application file for complete search history.

(56) References Cited

U.S. PATENT DOCUMENTS

| | | | | |
|---|---|---|---|---|
| 7,403,723 | B2 | 7/2008 | Moriya et al. | |
| 7,532,831 | B2 * | 5/2009 | Kitano | G03G 15/0266 399/44 |
| 7,532,832 | B2 * | 5/2009 | Hagiwara | G03G 15/0275 399/176 |
| 7,542,689 | B2 | 6/2009 | Ida et al. | |
| 8,335,444 | B2 | 12/2012 | Shibuya | |
| 8,606,131 | B2 * | 12/2013 | Shibuya | G03G 15/0216 399/50 |

FOREIGN PATENT DOCUMENTS

| | | |
|---|---|---|
| JP | 4543989 | 7/2010 |
| JP | 4902602 | 1/2012 |
| JP | 4929978 | 2/2012 |
| KR | 10-0792643 | 1/2008 |

* cited by examiner

*Primary Examiner* — Hoan Tran
(74) *Attorney, Agent, or Firm* — Staas & Halsey LLP

(57) ABSTRACT

An image forming apparatus includes a charging member configured to charge a photoreceptor, a power supply configured to provide charging power to the charging member, a measurement unit configured to measure a current provided to the charging member, and a controller configured to search for a current saturation point of the charging member using the current value measured by the measurement unit in a state in which fixed direct current (DC) power and varied alternating current (AC) power are supplied to the charging member, and control the power supply to perform a charging operation with only DC power corresponding to the searched current saturation point.

20 Claims, 14 Drawing Sheets

IMAGE FORMING APPARATUS AND METHOD FOR CONTROLLING CHARGING THEREOF

CROSS-REFERENCE TO RELATED APPLICATIONS

This application claims benefit of foreign priority from Korean Patent Application No. 10-2015-0131774, filed on Sep. 17, 2015, in the Korean Intellectual Property Office, the disclosure of which is incorporated herein by reference in its entirety.

BACKGROUND OF THE DISCLOSURE

1. Field

Apparatuses and methods consistent with the present disclosure relate to an image forming apparatus and a method for controlling charging thereof, and more particularly, to an image forming apparatus for performing charging using a magnitude of a current provided to a photoreceptor without measuring a surface potential of the photoreceptor, and a method for controlling charging thereof.

2. Related Art

An image forming apparatus refers to an apparatus for printing print data generated by a print control terminal device such as a computer to print paper. Examples of the image forming apparatus may include a photocopier, a printer, a facsimile, or a multi-function peripheral (MFP) having functions of a photocopier, a printer, and a facsimile, complexly implemented therein as a single apparatus.

Recently, laser print type image forming apparatuses have been commonly used, and a printing operation of a laser print type image forming apparatus includes charging, exposing, developing, transferring, and fusing processes.

In the charging process of the printing operation, a contact charging scheme of charging a photoreceptor by bringing a roller type charging member into contact with the photoreceptor is widely used. The contact charging scheme for charging a photoreceptor may include a direct current (DC) charging scheme of applying only a DC voltage and an AC+DC charging scheme of overlapping a DC voltage and an alternating current (AC) voltage and applying the overlapped voltage to a charging member.

Here, the DC charging scheme is a method of performing a charging operation only with DC power, which causes less damage to a surface of a photoreceptor to lengthen lifespan of the photoreceptor and generates less discharge products, compared with the AC+DC charging scheme. However, a surface potential of the photoreceptor formed due to DC charging is not uniform, compared with that printed and formed through AC+DC charging.

The AC+DC charging scheme is a method of performing a charging operation using AC power together with application of DC power, obtaining high uniformity of a surface potential of a photoreceptor, and when AC having a voltage with a sufficiently high peak value is applied to a specific DC voltage, the photoreceptor is charged to have the same surface potential as that of the DC voltage. However, a large amount of discharge occurring between a charging member and the photoreceptor damages a surface of the photoreceptor to degrade lifespan of the photoreceptor.

Meanwhile, a DC charging scheme is widely used in terms of lengthening lifespan of a photoreceptor. However, it is very complicate and difficult to determine a DC voltage to be applied in consideration of an environment, resistance of a charging member, and lifespan of a photoreceptor to form a desired surface potential of the photoreceptor.

In a recent DC charging scheme, a separate sensor for measuring a surface potential of a photoreceptor may be used, but it is also very complicate and difficult to use a separate sensor to measure a surface potential of a photoreceptor amid the trend in which image forming apparatuses are increasingly reduced in size.

SUMMARY

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides an image forming apparatus capable of performing charging using a magnitude of a current applied to a photoreceptor without measuring a surface potential of the photoreceptor, and a method for controlling charging thereof.

According to an aspect of the present disclosure, an image forming apparatus includes: a charging member configured to charge a photoreceptor; a power supply configured to provide charging power to the charging member; a measurement unit configured to measure a current provided to the charging member; and a controller configured to search for a current saturation point of the charging member using the current value measured by the measurement unit in a state in which fixed direct current (DC) power and varied alternating current (AC) power are supplied to the charging member, and control the power supply to perform a charging operation with only DC power corresponding to the searched current saturation point.

The power supply may include: a DC power supply configured to generate DC power; and an AC power supply configured to generate AC power, overlap the generated AC power in the DC power generated by the DC power supply, and provide the overlapped DC power and AC power to the charging member, and the measurement unit may include a first measurement unit configured to measure an output current from the DC power supply; and a second measurement unit configured to measure an output current from the AC power supply.

The controller may search for a saturation point using the output current value measured by the first measurement unit, and calculate a current saturation point of the charging member corresponding to the searched saturation point of the output current.

The controller may control the power supply to output varied AC power in a state in which DC power corresponding to a predetermined surface potential is output, and search for a saturation point of the output current.

The controller may control the AC power supply to vary AC power in unit of a preset magnitude and output the varied AC power.

The controller may control the AC power supply to output three pieces of AC power each having a different magnitude, create a relational expression between AC power and a measured current on the basis of two of the three pieces of AC power each having a different magnitude and current values measured in the two pieces of AC power, and determine a saturation point of the output current on the basis of the generated relational expression and a current value regarding the remaining AC power.

The AC power supply may generate square wave AC power of 3 KHz.

The controller may control the power supply to vary a magnitude of DC power in a state in which AC power is not output, and determine a magnitude of DC power in which the output current value measured by the second measurement unit and the current saturation point of the charging member are equal, as a charging voltage.

When a target surface potential is varied, the controller may calculate a current saturation point corresponding to the target surface potential by using a relational expression between previously stored input DC power and the surface potential.

The controller may control the power supply to sequentially provide pieces of DC power each having a different magnitude to the charging member in a state in which the AC power having a preset magnitude is maintained, and may generate and store a relational expression between input DC power and a surface potential by using a current value measured when the pieces of DC power each having a different magnitude are supplied.

According to another aspect of the present disclosure, a method for controlling charging of an image forming apparatus includes: supplying fixed direct current (DC) power and varied alternating current (AC) power to a charging member; measuring a current provided to the charging member; searching for a current saturation point of the charging member using the measured current value; and performing a charging operation only with DC power corresponding to the searched current saturation point.

In the searching for the current saturation point of the charging member, a saturation point of an output current may be searched using an output current value measured by a first measurement unit measuring an output current of a DC power supply, and a current saturation point of the charging member corresponding to the searched saturation point of the output current may be calculated.

In the supplying, varied AC power may be output in a state in which DC power corresponding to a predetermined surface potential is output.

In the supplying, AC power may be varied and output in unit of a preset magnitude.

In the supplying, three pieces of AC power each having a different magnitude may be output, and in the searching for the current saturation point of the charging member, a relational expression between AC power and a measured current may be created on the basis of two of the three pieces of AC power each having a different magnitude and current values measured in the two pieces of AC power, and a saturation point of the output current may be determined on the basis of the generated relational expression and a current value regarding the remaining AC power.

The method may further include: varying a magnitude of DC power in a state in which AC power is not output; and determining a magnitude of DC power in which the measured output current value and the current saturation point of the charging member are equal, as a charging voltage.

In the searching for the current saturation point of the charging member, when a target surface potential is varied, a current saturation point corresponding to the target surface potential may be calculated by using a relational expression between previously stored input DC power and the surface potential.

The method may further include: sequentially providing pieces of DC power each having a different magnitude in a state in which the AC power having a preset magnitude is maintained; and generating and storing a relational expression between input DC power and a surface potential by using a current value measured when the pieces of DC power each having a different magnitude are supplied.

Additional and/or other aspects and advantages of the disclosure will be set forth in part in the description which follows and, in part, will be obvious from the description, or may be learned by practice of the disclosure.

BRIEF DESCRIPTION OF THE DRAWINGS

The above and/or other aspects of the present disclosure will be more apparent by describing certain exemplary embodiments of the present disclosure with reference to the accompanying drawings, in which.

DESCRIPTION OF EMBODIMENTS

Figure 1:
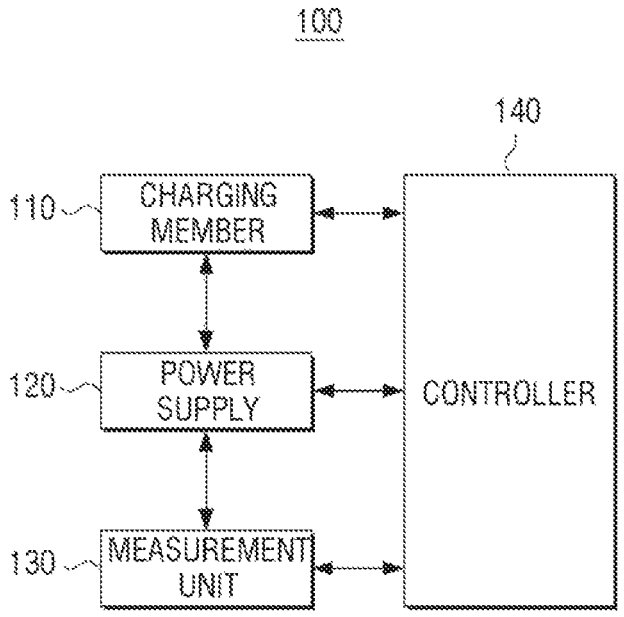
FIG. 1 is a block diagram illustrating a simple configuration of an image forming apparatus according to an exemplary embodiment of the present disclosure.

The exemplary embodiments of the present disclosure may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions are not described in detail since they would obscure the disclosure with unnecessary detail.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

In the exemplary embodiment of the present disclosure, a "module" or a "unit" performs at least one function or operation, and may be implemented with hardware, software, or a combination of hardware and software. In addition, a plurality of "modules" or a plurality of "units" may be integrated into at least one module except for a "module" or a "unit" which has to be implemented with specific hardware, and may be implemented with at least one processor (not shown).

Hereinafter, the present disclosure will be described in detail with reference to the accompanying drawings.

FIG. 1 is a block diagram illustrating a simple configuration of an image forming apparatus according to an exemplary embodiment of the present disclosure.

Referring to FIG. 1, an image forming apparatus 100 includes a charging member 110, a power supply 120, a measurement unit 130, and a controller 140. The image forming apparatus 100 may be a printer, a scanner, a photocopier, a facsimile, or a multi-function peripheral (MFP) having functions of a photocopier, a printer, and a facsimile, complexly implemented therein as a single apparatus.

The charging member 110 charges a photoreceptor. In detail, the charging member 110 has a roller shape and is disposed on one side of the photoreceptor such that the charging member 110 is in contact with one side of the photoreceptor. The charging member 110 may charge the photoreceptor upon receiving charging power from the power supply 120 (to be described hereinafter).

The power supply 120 provides charging power to the charging member 110. In detail, during a printing operation, the power supply 120 may provide only direct current (DC) power having a preset magnitude to the charging member 110, and during an operational process for determining DC power having the aforementioned preset magnitude (hereinafter, referred to as "during an operation of determining a charging voltage), the power supply 120 may overlap DC power having a preset magnitude and AC power having a preset peak magnitude and provide the overlapped power to the charging member 110.

During the operation of determining a charging voltage, the power supply 120 may output fixed DC power corresponding to a predetermined surface potential and output sequentially increased AC power. Here, the DC power may have a voltage of about 400 to 500 V. The AC power may be a square wave having a frequency of 3 KHz, having a magnitude greater than 0 and equal to or smaller than 2000 Vpp. The AC power may be sequentially increased according to an operation scheme, may be increased by stages in unit of a preset voltage magnitude (for example, 50 Vpp to 100 Vpp), or may have only specific voltage magnitudes (for example, 800 Vpp, 1200 Vpp, and 1700 Vpp).

During a process of generating a relational expression between input DC power and a surface potential, the power supply 120 may vary DC power in a preset unit and provide the varied DC power to the charging member 110, in a state in which AC power (for example, 1600 Vpp) making a sensing current be saturated is maintained.

The measurement unit 130 may measure a current provided to the charging member 110. In detail, the measurement unit 130 may measure a current of an output terminal of a DC power supply generating DC power and a current of an output terminal of an AC power supply finally provided to a charging member. For example, during a process of searching for a current saturation point (or a sensing current saturation point) of the charging member 110, the measurement unit 130 may measure a current of the output terminal of the DC power supply which generates DC power. After the current saturation point is searched, during a process of measuring a charging voltage, the measurement unit 130 may measure a current of the output terminal of the AC power supply.

The controller 140 controls the respective components of the image forming apparatus 100. In detail, the controller 140 determines whether the image forming apparatus 100 is required to determine a charging voltage. In detail, in a case in which the image forming apparatus 100 is initially installed, in a case in which consumables (for example, a photoreceptor, a toner, and the like) within the image forming apparatus 100 are changed, or in a case in which the image forming apparatus 100 has performed printing on sheets equal to or greater than a preset number of sheets, the controller 140 may determine that the image forming apparatus 100 is required to determine a charging voltage. The controller 140 may be configured as a control element such as a processor, or the like.

In a case in which it is not required to determine a charging voltage, when a printing command is input, the controller 140 may control the aforementioned power supply 120 to perform charging with a predetermined charging voltage.

Meanwhile, in a case in which it is required to determine a charging voltage, the controller 140 may control the power supply 140 to supply fixed DC power and varied AC power to the charging member 110. In detail, the controller 140 may control the power supply 120 to output AC power varied in a state in which DC power corresponding to a predetermined surface potential is output. Here, the controller 140 may control the power supply 120 to provide sequentially increased AC power to the charging member 110 or to provide AC power varied in unit of a preset magnitude to the charging member 110. Also, in a case in which it is required to rapidly determine a charging voltage, the controller 140 may control the power supply 120 to output three pieces of AC power each having a different magnitude.

The controller 140 may search for a current saturation point of the charging member 110 using a magnitude of a current measured by the measurement unit 130 at a point in time at which the varied AC power is provided. In detail, using an output current of the output terminal of the DC power supply, the controller 140 may search for a saturation time point of the output current, and calculate a current saturation point of the charging member 110 at the corresponding saturation time point. This will be described with reference to FIG. 7 hereinafter.

Meanwhile, in a case in which only three pieces of AC power each having a different magnitude are supplied to the charging member 110, the controller 140 may create a relational expression between AC power and a measured current on the basis of two of the three pieces of AC power each having a different magnitude and current values measured in the two pieces of AC power, and determine a saturation point of the output current on the basis of the generated relational expression and a current value regarding the remaining AC power. This operation will be described with reference to FIG. 8 hereinafter.

When the current saturation point is determined, the controller 140 may control the power supply 120 to vary a magnitude of the DC power in a state in which AC power is not output. The controller 140 may determine a magnitude of DC power in which the output current output from the charging member 110 and the current of the previously determined current saturation point are equal, as a charging voltage.

Meanwhile, when a target surface potential is varied, the controller 140 may repeat the process of determining that it is required to determine a charging voltage, searching for a current saturation time point as mentioned above, and determining a corresponding charging voltage.

Alternatively, the controller 140 may calculate a current saturation point corresponding to the target surface potential using a previously stored relational expression between input DC power and a surface potential. Here, the previously stored relational expression may be obtained and stored by a manufacturer when a product is released, and may be previously generated by the image forming apparatus 100 by performing the following operation when the image forming apparatus 100 is initially installed.

In detail, in order to create the aforementioned relational expression, the controller 140 may control the power supply 120 to sequentially provide pieces of DC power each having a different magnitude to the charging member 110 in a state in which AC power having a preset magnitude (in detail, power sufficient for saturating the sensing current) is maintained. Using the current value measured when the pieces of DC power each having a different magnitude are supplied, the controller 140 may create a relational expression between the input DC power and a surface potential and store the created relational expression in the storage unit 180 as described hereinafter. This operation will be described with reference to FIG. 10 hereinafter.

As described above, the image forming apparatus 100 according to the present exemplary embodiment may accurately form a photoreceptor surface potential without using a potential sensor for measuring a photoreceptor surface potential, compared with the method of directly measuring a current flowing between a charging member and a photoreceptor.

In the above, the brief components constituting the image forming apparatus 100 has been described, but various components may be additionally provided when the image forming apparatus is implemented. This will be described with reference to FIG. 2 hereinafter.

Figure 2:
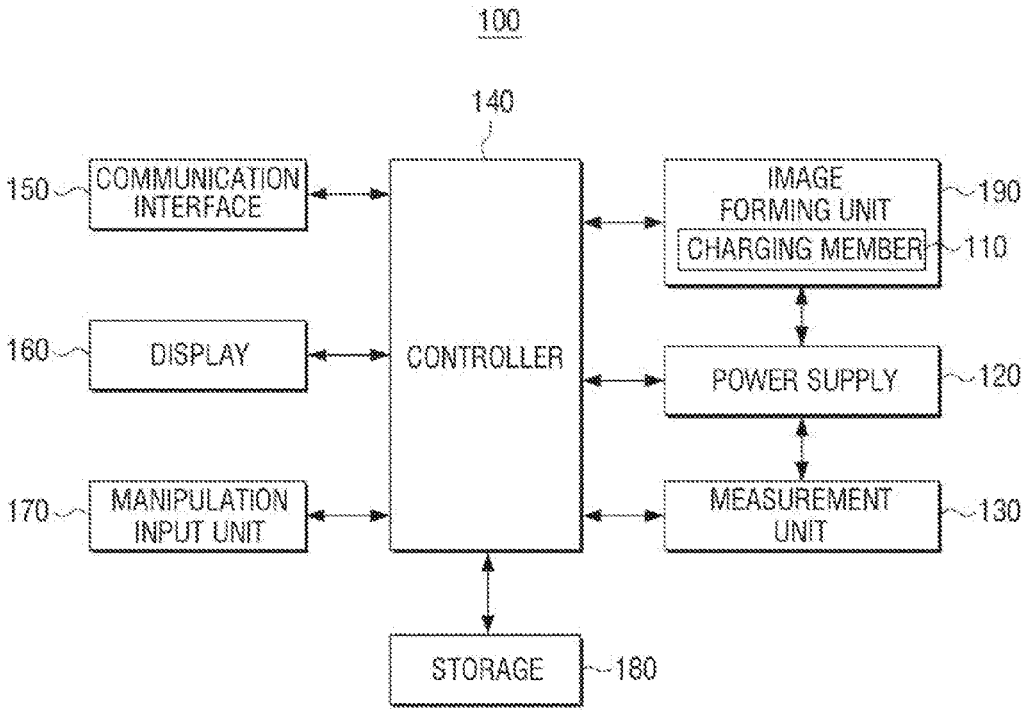
FIG. 2 is a block diagram illustrating a specific configuration of an image forming apparatus according to an exemplary embodiment of the present disclosure.

FIG. 2 is a block diagram illustrating a specific configuration of an image forming apparatus according to an exemplary embodiment of the present disclosure.

Referring to FIG. 2, the image forming apparatus 100 includes the power supply 120, the measurement unit 130, the controller 140, a communication interface 150, a display 160, a manipulation input unit 170, a storage 180, and an image forming unit 190.

The charging member 110, the power supply 120, and the measurement unit 130 perform a charging function. In the image forming apparatus 100, only the charging member 110, the power supply 120, and the measurement unit 130 may be referred to as a charging device, and a detailed configuration and operation of the charging device will be described with reference to FIG. 3 hereinafter.

The charging member 110 may be a component of the image forming unit 190.

The communication interface 150 may be connected to a terminal device (not shown) such as a mobile device (a smartphone or a tablet personal computer (PC)), a PC, a notebook PC, a personal digital assistant (PDA), or a digital camera, and receive a file and print data from the terminal device (not shown). In detail, the communication interface 150 may be formed to connect the image forming apparatus 100 to an external device, and may be connected to the terminal device through a local area network (LAN) and the Internet, or may be connected to the terminal device through a universal serial bus (USB) port or a wireless communication port (for example, W-Fi 802.11a/b/g/n, NFC, or Bluetooth) as well.

The display 160 displays various types of information provided in the image forming apparatus 100. In detail, the display 160 may display a user interface window for receiving various functions provided by the image forming apparatus 100. The display 160 may be a monitor such as a liquid crystal display (LCD), a cathode ray tube (CRT), or an organic light emitting diode (OLED), or may also be implemented as a touch screen able to perform a function of the manipulation input unit 170 as described hereinafter.

The display 160 may display a control menu for performing a function of the image forming apparatus 100.

The manipulation input unit 170 may receive a function selection and a control command regarding a corresponding function from a user. Here, the function may include a print function, a duplication function, a scan function, and a facsimile transmission function. The manipulation input unit 170 may receive the control command through a control menu displayed on the aforementioned display 160.

The manipulation input unit 170 may be implemented as a plurality of buttons, a keyboard, or a mouse, and may also be implemented as a touch screen able to simultaneously perform a function of the display 160.

The storage 180 may store print data received through the communication interface 150. The storage 180 may store various settlement conditions (for example, a temperature condition according to an operational state of the image forming apparatus 100). The storage 180 may be implemented as an internal storage medium and an external storage medium of the image forming apparatus 100, for example, a removable disk including a USB memory, a storage medium connected to a host, and a Web server through a network.

The image forming unit 190 may print data. In detail, the image forming unit 190 may parse a file previously stored in the storage 180 or print data received from a terminal device (not shown), render the parsed file or data, and print the rendered file or data on print paper.

The image forming unit 190 may be a device able to perform color printing by including a plurality of photoreceptors. In this case, the aforementioned charging member 110 may be installed by a number corresponding to the number of the photoreceptors, charging power of each charging device may be different, and the step of determining a magnitude of charging power described above may be performed by the number of the photoreceptors.

The controller 140 controls respective components of the image forming apparatus 100. In detail, the controller 140 determines an operational state of the image forming apparatus 100. For example, when the image forming apparatus 100 is initially turned on or when it is determined that a printing operation is ready to start (for example, in a case in which the user controls the manipulation input unit or in a case in which print data is received), the controller 104 may determine that an operational state of the image forming apparatus 100 is a prepared state (or a ready state).

When print data is received from the outside and an operation such as parsing is completed to start a print operation, the controller 140 may determine that an operational state of the image forming apparatus 100 is a print state. When the print operation is completed and a preset period of time has elapsed, the controller 140 may determine that an operational state of the image forming apparatus 100 is an idle mode (or a standby mode).

In describing FIG. 2, it is illustrated that the power supply 120 and the measurement unit 130 are external elements of the image forming unit 190, but the power supply 120 and the measurement unit 130 may be included in the image forming unit 190 when implemented.

Also, in FIGS. 1 and 2, only a general function of the image forming apparatus 100 is illustrated and described, but, as well as the aforementioned components, the image forming apparatus 100 may further include a scan unit performing a scan function and a facsimile transmitting/receiving unit for performing a function of facsimile transmission/reception function according to functions supported by the image forming apparatus 100.

Figure 3:
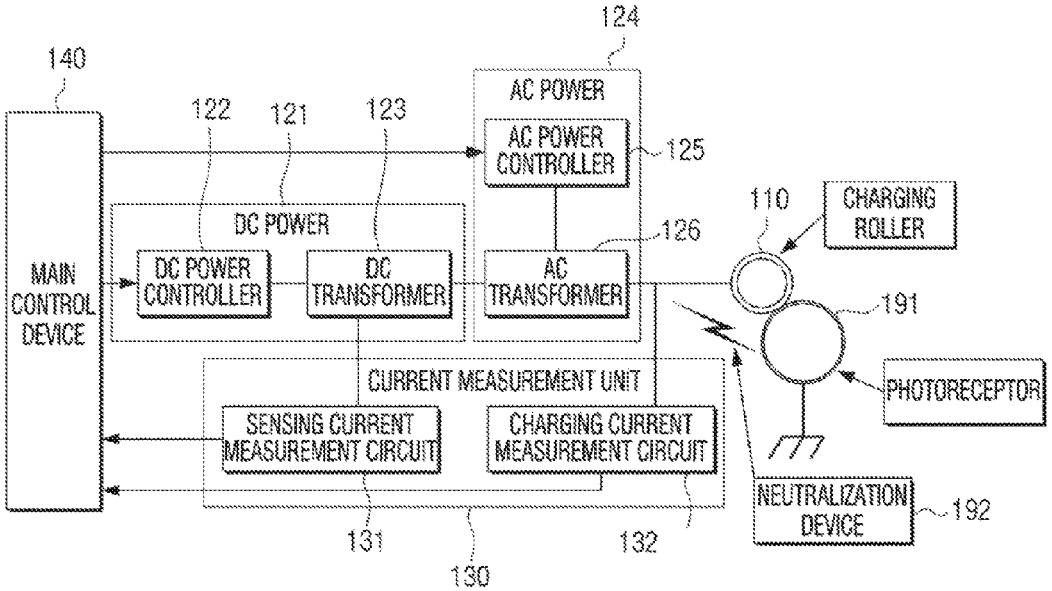
FIG. 3 is a circuit diagram of the image forming apparatus of FIG. 1.

FIG. 3 is a circuit diagram of the image forming apparatus of FIG. 1.

Referring to FIG. 3, the image forming apparatus 100 includes the charging member 110, a photoreceptor 191, a neutralization device 192, the power supply 120, the measurement unit 130, and the controller 140.

The charging member 110 may charge one side of the photoreceptor 191 upon receiving charging power from the power supply 120.

The photoreceptor 191 performs charging, exposing, developing, and transferring through a rotational process. First, after a surface of the photoreceptor 191 (or an organic photo conductive unit) is charged with a negative (−) charge by the charging member 110, a latent image is formed on the surface of the photoreceptor 191 by a laser beam scanned through a laser scanning unit (LSU). Next, a toner is adhered to the latent image formed on the surface of the photoreceptor 191 to form a visual image, and a transferring operation is performed such that the toner adhered to the surface of the photoreceptor 191 is attached to print paper.

After the transfer operation, the photoreceptor is neutralized to a predetermined potential by the neutralization device 192.

The power supply 120 generates charging power. As illustrated in FIG. 3, the power supply 120 may include a DC power supply 121 and an AC power supply 124.

The DC power supply 121 generates DC power having a preset magnitude according to a control command from the controller 140. In detail, the DC power supply 121 is a constant voltage circuit, and in order to generate a voltage magnitude according to a control command from the controller 140, a DC power controller 122 may control a current of a primary terminal of a DC transformer 123 upon receiving feedback of a DC current output from the DC transformer 123.

The AC power supply 124 generates AC power having a preset magnitude according to a control command from the controller 140. In detail, the AC power supply 124 may include an AC power controller 125 and an AC transformer 126.

The AC transformer 126 may amplify AC power provided from the outside into AC power having a preset magnitude and output the amplified AC power, and the AC power controller 125 may control the AC transformer 126 to generate AC power having a preset magnitude according to the control command from the controller 140.

The AC power supply 124 may overlap the generated AC power and the DC power output from the DC power supply 121 and output the overlapped power to the charging member 110.

The measurement unit 130 may include a first measurement unit 131 (or a sensing current measurement circuit) and a second measurement unit 132 (or a charging current measurement circuit).

The first measurement unit 131 may measure a magnitude of a current output from the DC power supply 121. A measurement result (or a sensing current) from the first measurement unit 131 may be used in a process of determining a charging voltage.

The second measurement unit 132 may measure a magnitude of a current (or a charging DC current) output from the AC power supply 124.

In a case in which it is required to determine a charging voltage, the controller 140 may control the DC power supply 121 to generate DC power corresponding to a preset surface potential, and in a state in which the DC power is fixed and output, the controller 140 may control the AC power supply 124 to output varied AC power. Here, the controller 140 may control the AC power supply 124 to provide sequentially increased AC power to the charging member 110 or to provide AC power varied in unit of a preset magnitude to the charging member 110. Also, in a case in which it is required to rapidly determine a charging voltage, the controller 140 may control the AC power supply 124 to output three pieces of AC power each having a different magnitude.

The controller 140 may search for a current saturation point of the charging member 110 using a magnitude of a current measured by the first measurement unit 131 at a point in time at which the varied AC power is provided. In detail, the controller 140 may search for a saturation time point of the current value measured by the first measurement unit 131, and calculate a current saturation point of the charging member 110 at the corresponding saturation time point. This will be described in detail with reference to FIG. 7.

Meanwhile, in a case in which only three pieces of AC power each having a different magnitude are supplied to the charging member 110, the controller 140 may create a relational expression between AC power and a measured current on the basis of two of the three pieces of AC power each having a different magnitude and current values measured in the two pieces of AC power, and determine a saturation point of an output current on the basis of the generated relational expression and a current value regarding the remaining AC power. This operation will be described with reference to FIG. 8 hereinafter.

When the current saturation point is determined, the controller 140 may control the AC power supply 124 not to output AC power and control the DC power supply 121 to vary a magnitude of DC power. The controller 140 may determine a magnitude of DC power in which the current measured by the second measurement unit 132 and the current of the previously determined current saturation point are equal, as a charging voltage.

Meanwhile, when a target surface potential is varied, the controller 140 may repeat the process of determining that it is required to determine a charging voltage, searching for a current saturation time point as mentioned above, and determining a corresponding charging voltage.

Alternatively, the controller 140 may calculate a current saturation point corresponding to the target surface potential using a previously stored relational expression between input DC power and a surface potential. Here, the previously stored relational expression may be obtained and stored by a manufacturer when a product is released, and may be previously generated by the image forming apparatus 100 by performing the following operation when the image forming apparatus 100 is initially installed.

Meanwhile, when a printing process is performed, the controller 140 may control the DC power supply 121 to provide the DC charging voltage determined in the previous process to the charging member 110 and control the AC power supply 124 not to output charging power.

Hereinafter, an operation of determining a charging voltage will be described in detail with reference to FIGS. 4 through 8.

Figure 4:
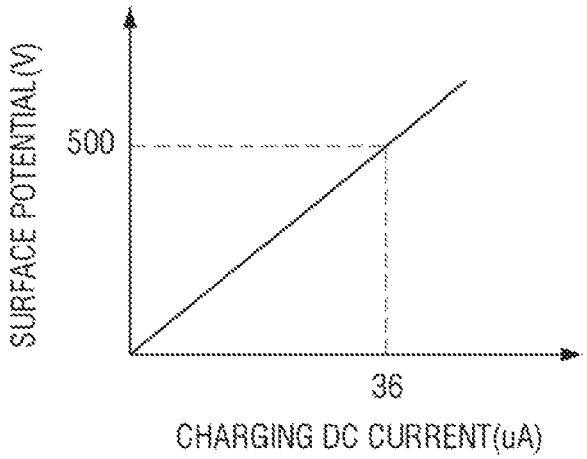
FIG. 4 is a view illustrating a relationship between a charging DC current and a surface potential.
Figure 5:
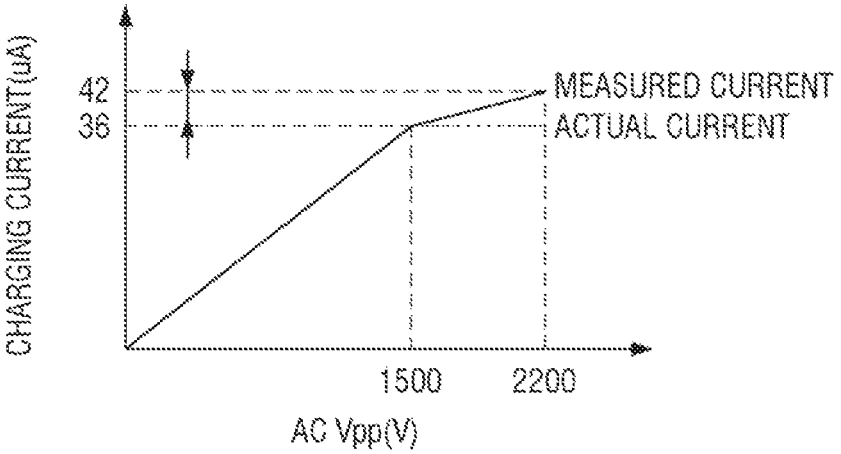
FIG. 5 is a view illustrating a relationship between AC power and a charging current.
Figure 6:
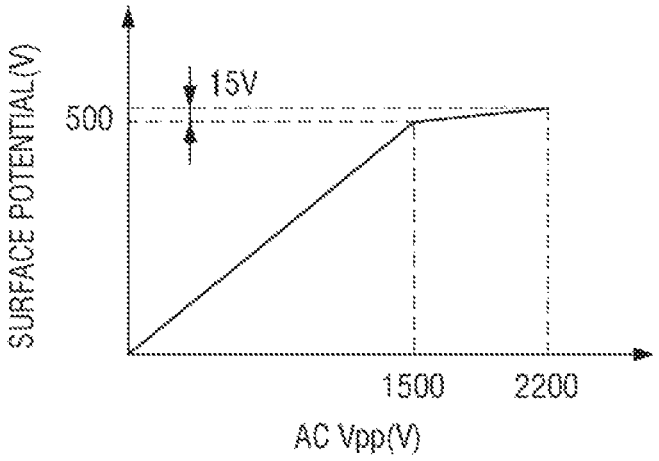
FIG. 6 is a view illustrating a relationship between AC power and a surface potential.
Figure 7:
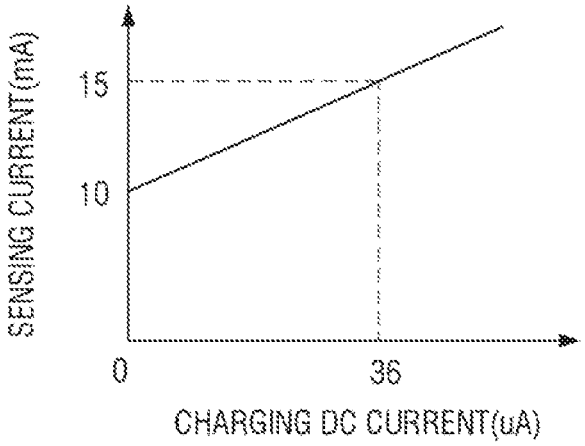
FIG. 7 is a view illustrating a relationship between a charging current and a sensing current.

FIG. 4 is a view illustrating a relationship between a charging DC current and a surface potential, FIG. 5 is a view illustrating a relationship between AC power and a charging current, FIG. 6 is a view illustrating a relationship between AC power and a surface potential, and FIG. 7 is a view illustrating a relationship between a charging current and a sensing current.

A surface potential of a photoreceptor is determined by a DC current amount flowing between the photoreceptor and a charging roller as illustrated in FIG. 4. Thus, even though the surface potential of the photoreceptor is not measured, the surface potential of the photoreceptor may be detected by measuring a DC current amount flowing between the photoreceptor and the charging roller.

For example, in a case in which a surface potential of the photoreceptor is to be formed as 500V, if a current of 36 μA flows between the photoreceptor and the charging roller, the surface potential of the photoreceptor is 500V, without having to detect how much the surface potential of the photoreceptor is. Meanwhile, the relational expression illustrated in FIG. 4 is a relational expression in the specific image forming apparatus, and thus, a system having a different environment may have a relational expression having a different slope.

In order to know the charging DC current described above, the controller 140 outputs AC power in an overlapping manner in a state in which the DC power which is the same as the surface potential described above is applied. In a case in which a peak-to-peak AC voltage is gradually increased from 0V, a current flowing between the photoreceptor and the charging roller may be obtained as illustrated in FIG. 5.

Referring to FIG. 5, as the peak-to-peak AC voltage is increased, a charging DC current is linearly increased at an initial stage. Also, when the peak-to-peak AC voltage (ex 1500 Vpp) is equal to or higher than a predetermined value, a charging DC current is saturated and an actual charging current (the dotted line of FIG. 5) is maintained at a predetermined value.

However, in a case in which a charging DC current is measured between the power supply and the charging roller, a phenomenon in which the DC current value measured by the second measurement unit 132 is continuously increased even after a saturation point occurs.

Also, the surface potential measured by the surface potential sensor in the AC+DC charging is obtained as illustrated in FIG. 6. Referring to FIG. 6, it can be seen that, when the peak-to-peak AC voltage is increased to be higher than the peak-to-peak AC voltage forming the surface potential 500V, a surface potential is increased even though it is small.

Thus, it can be seen that overlapping a peak-to-peak AC voltage excessively higher than a saturated peak-to-peak AC voltage in the charging DC current causes an error in measuring the charging DC current.

Thus, in the present embodiment, when both AC power and DC power (AC+DC) are used, the current input to the charging member (hereinafter, referred to as a "charging current") is not measured and only the current value output only from the DC power supply (hereinafter, referred to as a "sensing current") is measured and used.

Referring to FIG. 7, the sensing current measured by the first measurement unit 131 and the charging DC current measured by the second measurement unit 132 are in a specific function relation. Such a specific function relation is not changed by an influence of an environment, resistance of the charging member, and lifespan of the photoreceptor.

Figure 8:
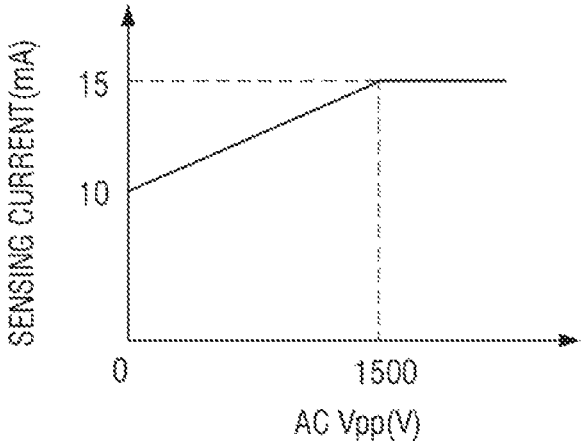
FIG. 8 is a view illustrating a relationship between AC power and a sensing current.

Referring to FIG. 8, when the peak-to-peak AC voltage is increased, the current measured by the first measurement unit 131 is linearly increased. Also, it can be seen that, when the peak-to-peak AC voltage is equal to or greater than a predetermined value, the measurement value from the first measurement unit 131 is maintained at a predetermined value.

In this manner, in the present embodiment, it can be seen that, when AC+DC power is provided to the charging member 110, a current value output from the DC power supply 121 is measured and a current saturation time point is searched, and thus, there is no influence of the AC voltage and an excellent result is obtained in terms of noise, compared with the case of using a current measured between a power supply and a charging roller or between a photoreceptor and a ground.

Thus, the controller 140 searches for a current saturation point by using a current value measured by the first measurement unit 131, while inputting fixed DC to the charging member 110 and varying a magnitude of AC power.

When the current saturation point is searched through the aforementioned process, a charging DC current value is determined by using a relational expression such as that illustrated in FIG. 7, and AC power is deactivated and only a DC voltage is applied to search for a charging voltage corresponding to the charging DC current value.

The controller 140 performs an image formation operation by applying the charging voltage obtained in the printing process. In detail, the charging voltage obtained in the previous process is the charging DC current (36 μA) corresponding to the surface potential (500V), and thus, a desired surface potential may be formed on a desired photoreceptor even without having to measure the surface potential in the charging process.

Meanwhile, in the above descriptions, in order to search for a current saturation point, low AC power is gradually increased to high AC power and a point at which a current is not changed is searched, but when implemented, high AC power equal to or higher than a saturation point may be first applied and power may be gradually lowered and a point in time at which a current value is changed may be searched. Also, a current saturation point may be determined by applying only three different predetermined pieces of power. This will be described with reference to FIG. 9 hereinafter.

Figure 9:
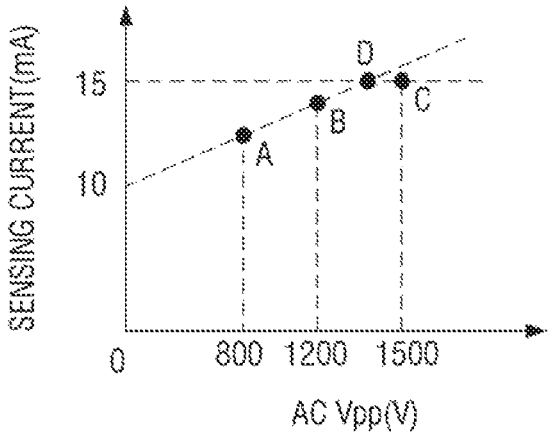
FIG. 9 is a view illustrating a measurement for rapidly sensing charging.

FIG. 9 is a view illustrating a measurement for rapidly sensing charging.

Referring to FIG. 9, when a charging potential is required to be determined, points A, B, and C are obtained by measuring sensing currents, while changing three different AC voltages 800 Vpp, 1200 Vpp, and 1500 Vpp, in a state in which DC power corresponding to a surface potential is maintained. Here, one applied AC voltage is lower than an AC voltage corresponding to a current saturation point, and one AC voltage may be higher than the AC voltage corresponding to the current saturation point.

Thus, the controller 130 may create a linear relational expression connecting the points A and B on the basis of two current values corresponding to the low AC voltages and determine a current value at a point corresponding to a voltage of a point at which a horizontal line corresponding to a current value corresponding to the high AC voltage and an extended line of AB meet, as a sensing current value.

When the sensing current value is determined, a charging DC current value is determined using the relational expression as illustrated in FIG. 7 and a voltage corresponding to the determined charging DC current value may be searched applying only a DC voltage, while deactivating AC power.

Figure 10:
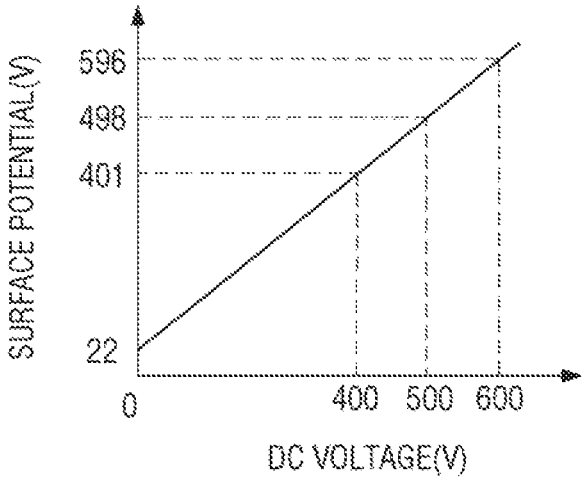
FIG. 10 is a view illustrating a relationship between a DC voltage and a surface potential in AC+DC charging.

FIG. 10 is a view illustrating a relationship between a DC voltage and a surface potential in AC+DC charging.

When the image forming apparatus performs a printing operation according to an electronic photo scheme using a photoreceptor, if a neutralization process is not performed after transferring is performed, a surface potential of the photoreceptor after re-charging may not be formed to be uniform according to whether exposure is performed but has a difference. When an image is formed in this state, a ghost image may be formed as a previously exposed image reappears.

Thus, in consideration of a rotation direction of the photoreceptor, neutralization is performed before passing through the charging roller to form a uniform surface potential on the photoreceptor.

However, even though neutralization is performed by the neutralization device, the surface potential of the photoreceptor is not 0V and, in a state in which a surface potential having a few volts to 100V or greater is formed according to the surface potential before neutralization, the photoreceptor may pass through the charging roller.

Thus, it is required to know the surface potential after neutralization in advance and vary the surface potential accordingly in order to more accurately form the surface potential of the photoreceptor.

For the operation, DC power (ex, 400, 500, 600) is sequentially overlapped in the peak-to-peak AC voltage 1600 Vpp causing a sensing current to be saturated to measure a surface potential. A measure value through the measurement is shown in FIG. 10.

Referring to FIG. 10, in a relational expression of the input DC power and the surface potential, the surface potential is not 0V. That is, even though the DC voltage is increased to 100V in a state in which the sensing current is saturated by applying AC+DC voltage, the surface potential of the photoreceptor is not increased to 100V and the charging DC current is also the same as the surface potential of the photoreceptor. Such a relation may be expressed by Equation 1 below.

$$V_o = V_b + \alpha i \qquad \text{[Equation 1]}$$

Here, Vo is a surface potential of the photoreceptor after charging, Vb is a surface potential of the photoreceptor after neutralization, $\alpha$ is a slope between a charging DC current and the surface potential, and i is a charging DC current.

Vb and $\alpha$ may be obtained from a plurality of sensing current relational expressions measured while changing a DC voltage by overlapping a peak-to-peak AC voltage in which the sensing current is saturated and the relation of FIG. 7. Thus, the charging DC current may be calculated through Equation 2 below, without directly measuring the charging DC current with respect to the surface potential of the photoreceptor.

Equation 2

$$i = \frac{V_o - V_b}{\alpha} \qquad \text{[Equation 2]}$$

For example, in a case in which a surface potential of the photoreceptor is changed to 400V when a charging DC current measured through AC+DC charging sensing with a DC voltage of 500V is 35 uA, if the charging DC current is changed to 28 uA, a surface potential of the photoreceptor after actual neutralization is not 0V, and thus, the surface potential of the photoreceptor after charging is formed as 404V higher than 400V.

Figure 11:
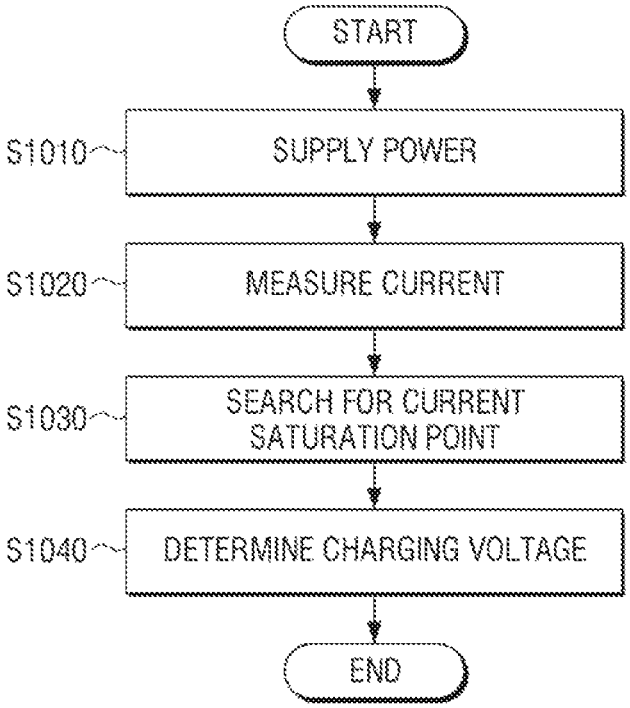
FIG. 11 is a view illustrating a method for controlling charging according to an exemplary embodiment of the present disclosure.

Thus, after Vb and a of Equation 1 are obtained in the charging sensing stage and stored, if it is required to change the surface potential of the photoreceptor in forming an image, the charging DC current may be calculated and applied to thereby control to more accurately form the surface potential of the photoreceptor FIG. 11 is a view illustrating a method for controlling charging according to an exemplary embodiment of the present disclosure.

Referring to FIG. 11, fixed DC power and varied AC power are supplied to a charging member (S1010). In detail, in a state in which DC power corresponding to a predetermined surface potential is output, varied AC power may be output. Here, the DC power may have a voltage of about 400 to 500 V. The AC power may be a square wave having a frequency of 3 KHz, having a magnitude greater than 0 and equal to or smaller than 2000 Vpp. The AC power may be sequentially increased, may be increased by stages in unit of a preset voltage magnitude (for example, 50 Vpp to 100 Vpp), or may have only specific voltage magnitudes (for example, 800 Vpp, 1200 Vpp, and 1700 Vpp).

A current provided to the charging member is measured (S1020). In detail, a current of the DC power output from an output terminal of a DC power supply may be measured.

A current saturation point of the charging member is searched using the measured current (S1030). In detail, a point at which the measured current is not changed even though AC power is varied may be searched. A current saturation point of the charging member corresponding to the saturation point of the searched output current may be calculated by using the relational expression of FIG. 7.

A charging operation is performed only with DC power corresponding to the searched current saturation point (S1040). In detail, in a state in which AC power is not output, a magnitude of the DC power is varied, and a magnitude of DC power in which the measured output current and the current saturation point of the charging member are equal may be determined as a charging voltage, and a charging operation may be performed using the determined charging voltage.

Thus, in the method for controlling charging according to the present exemplary embodiment, a photoreceptor surface potential may be formed more accurately without using a potential sensor for measuring a photoreceptor surface potential, compared with the method of directly measuring a current flowing between a charging member and a photoreceptor. The method for controlling charging as illustrated in FIG. 11 may be executed in an image forming apparatus including the configuration of FIGS. 1 through 3 or may also be executed in an image forming apparatus having other configuration.

Also, the method for controlling charging as described above may be implemented as at least one execution program for executing the driving control method described above, and such an execution program may be stored in a computer-readable recording medium.

Thus, each block of the present disclosure may be implemented as a computer-recordable code in a computer-readable recording medium. The computer-readable recording medium may be a device storing data that can be read by a computer system.

Figure 12:
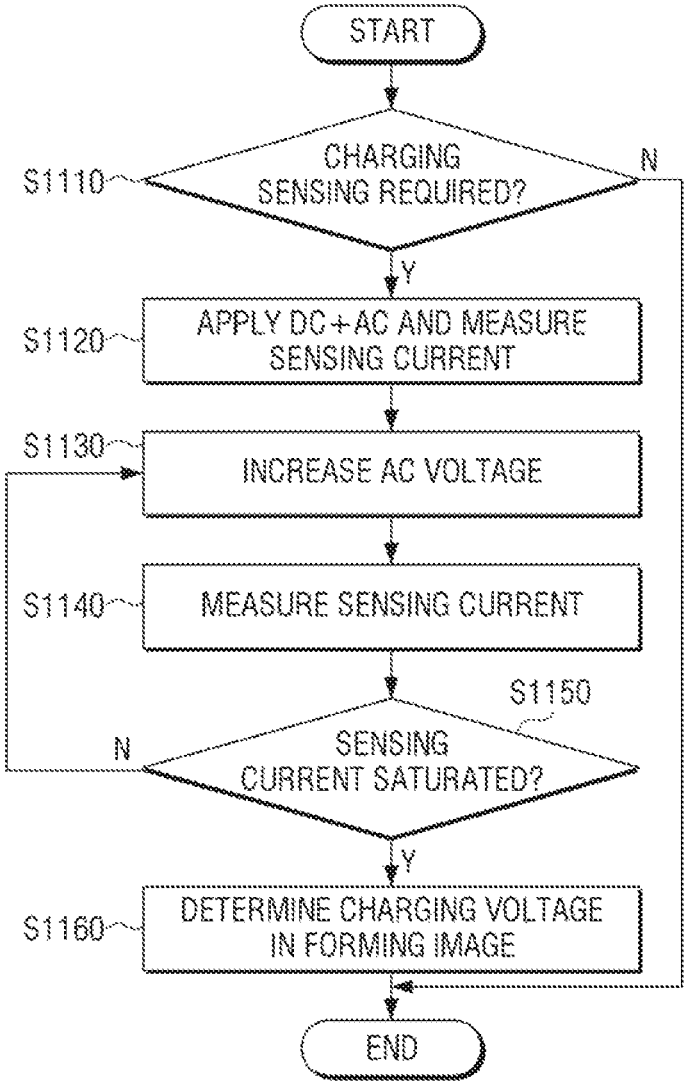
FIG. 12 is a view illustrating a method for measuring a saturation current according to a first exemplary embodiment of the present disclosure.

FIG. 12 is a view illustrating a method for measuring a saturation current according to a first exemplary embodiment of the present disclosure.

Referring to FIG. 12, first, it is determined whether charging sensing is required (S1110). In detail, when an image is already formed through charging sensing, a charging voltage is determined, and thereafter, charging sensing is not performed because a charging sensing condition is not met (S1110-N), an operation of forming an image with an existing determined charging voltage may be performed.

However, in a case in which the charging sensing condition is met and a charging sensing operation is performed (S1110-Y), predetermined DC voltage and AC voltage (1000 Vpp) as charging sensing initial values are applied and a sensing current may be measured (S1120).

Thereafter, the AC voltage may be increased by a preset voltage (50 Vpp to 100 Vpp) (S1130), and a sensing current may be measured (S1140).

It is determined whether the sensing current is saturated, compared with the sensing current in the previous step (S1150). When the sensing current is not saturated (S1150-N), the AC voltage is increased and the sensing current is measured. This is repeated until when the sensing current is saturated.

When the sensing current is saturated (S1150-Y), a charging DC current value is determined using the relational expression of FIG. 7 with the obtained sensing current saturation point, and a voltage corresponding to the charging DC current value is searched by applying only a DC voltage, while deactivating AC power (S1160).

Thus, in the method for measuring a saturation current according to the first exemplary embodiment, a charging voltage may be determined even though a surface potential is not measured. The method for measuring a saturation current illustrated in FIG. 12 may be executed in an image forming apparatus including the configuration of FIG. 1 or 2 or may also be executed in an image forming apparatus having other configuration.

Also, the method for measuring a saturation current as described above may be implemented as at least one execution program for executing the driving control method described above, and such an execution program may be stored in a computer-readable recording medium.

Figure 13:
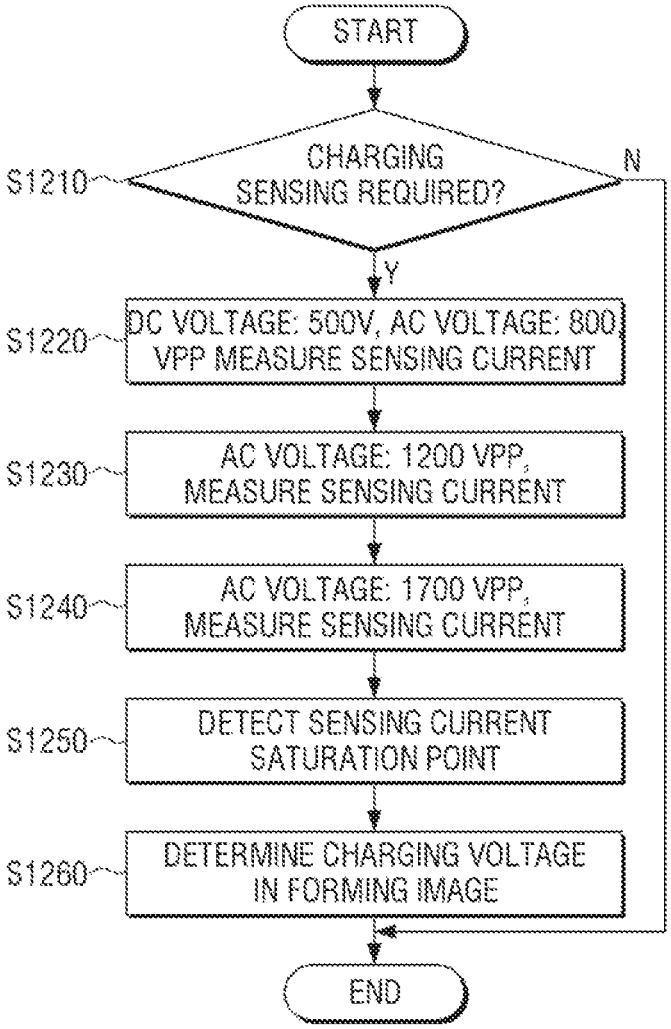
FIG. 13 is a view illustrating a method for measuring a saturation current according to a second exemplary embodiment of the present disclosure.

FIG. 13 is a view illustrating a method for measuring a saturation current according to a second exemplary embodiment of the present disclosure. Specifically, the second exemplary embodiment relates to a method for rapidly detecting current saturation, compared with the first exemplary embodiment.

Referring to FIG. 13, first, it is determined whether charging sensing is required (S1210). In detail, when an image is already formed through charging sensing, a charging voltage is determined, and thereafter, charging sensing is not performed because a charging sensing condition is not met (S1210-N), an operation of forming an image with an existing determined charging voltage may be performed.

However, in a case in which the charging sensing condition is met and a charging sensing operation is performed (S1210-Y), two points of peak-to-peak AC voltages before a sensing current is saturated and one point of a peak-to-peak AC voltage after a sensing current saturation point are selected and a sensing current is measured to obtain points A, B, and C (S1220, S1230, and S1240) as illustrated in FIG. 9. Here, since peak-to-peak AC voltage higher than the saturation point is applied to the sensing current at the point C, an actual surface potential of a photoreceptor a value higher than 500V. However, when a peak-to-peak AC voltage is searched in the straight line determined by the points A and B using the sensing current corresponding to the point C, an accurate sensing current saturation point may be quickly searched (S1250).

When the sensing current saturation point is searched, a charging DC current value is determined by using the relational expression of FIG. 7 with the obtained sensing current saturation point, and a voltage corresponding to the charging DC current value is searched by applying only a DC voltage, while deactivating AC power (S1260).

Meanwhile, when implemented, a sensing current saturation point may be more precisely obtained by applying a plurality of AC voltages, that is, by increasing the number of measurements.

Thus, in the method for measuring a saturation current according to the second exemplary embodiment, a charging voltage may be determined even though a surface potential is not measured, and since the charging voltage is determined by current measurement according to three potentials, the operation may be performed more quickly. The method for measuring a saturation current illustrated in FIG. 13 may be executed in an image forming apparatus including the configuration of FIG. 1 or 2 or may also be executed in an image forming apparatus having other configuration.

Also, the method for measuring a saturation current as described above may be implemented as at least one execution program for executing the driving control method described above, and such an execution program may be stored in a computer-readable recording medium.

Figure 14:
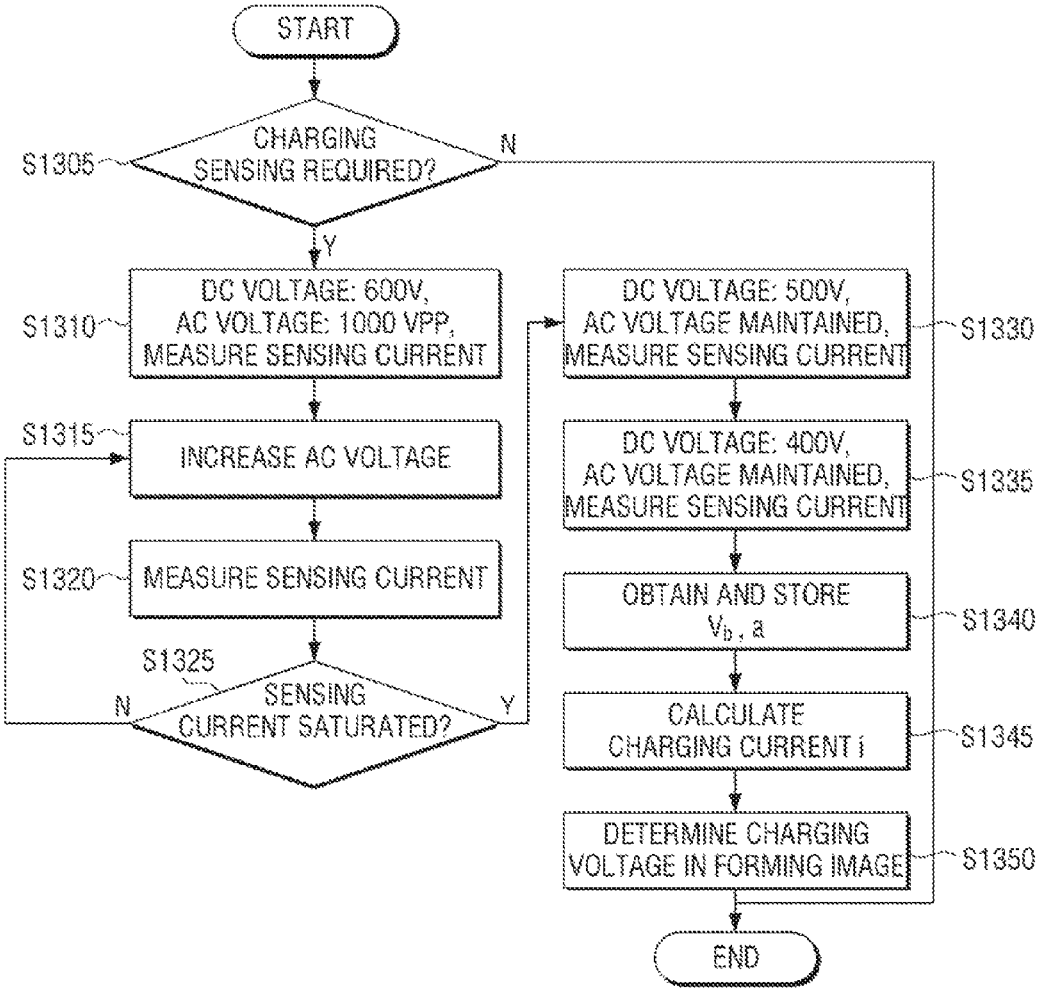
FIG. 14 is a view illustrating a method for measuring a saturation current according to a third exemplary embodiment of the present disclosure.

FIG. 14 is a view illustrating a method for measuring a saturation current according to a third exemplary embodiment of the present disclosure.

Referring to FIG. 14, first, it is determined whether charging sensing is required (S1305). In detail, when an image is already formed through charging sensing, a charging voltage is determined, and thereafter, charging sensing is not performed because a charging sensing condition is not met (S1305-N), an operation of forming an image with an existing determined charging voltage may be performed.

However, in a case in which the charging sensing condition is met and a charging sensing operation is performed (S1305-Y), a preset DC voltage (ex 600V) and an AC voltage (1000 Vpp) may be applied and a sensing current may be measured (S1310).

Thereafter, the AC voltage may be increased by a preset voltage (50 Vpp to 100 Vpp) (S1315) and a sensing current may be measured (S1320).

It is determined whether the sensing current is saturated, compared with the sensing current in the previous step (S1325). When the sensing current is not saturated (S1325-N), the AC voltage is increased and the sensing current is measured. This is repeated until when the sensing current is saturated.

When the sensing current is saturated (S1325-Y), a peak-to-peak AC voltage is maintained, and sensing currents are measured, while changing the DC voltage to 400V and 500V (S1330 and S1335).

Vb and a of Equation 1 are obtained from the three points measured in the aforementioned process and stored (S1340).

In a case in which a surface potential is required to be changed, a charging DC current may be calculated using the obtained Vb and a and Equation 2 (S1345), and a DC charging voltage corresponding to the calculated DC current may be determined (S1350).

Thus, in the method for measuring a saturation current according to the third exemplary embodiment, since a charging voltage is determined in consideration of even neutralization performance, a surface potential of a photoreceptor may be more accurately formed. The method for measuring a saturation current illustrated in FIG. 14 may be executed in an image forming apparatus including the configuration of FIG. 1 or 2 or may also be executed in an image forming apparatus having other configuration.

Also, the method for measuring a saturation current as described above may be implemented as at least one execution program for executing the driving control method described above, and such an execution program may be stored in a computer-readable recording medium.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. An image forming apparatus comprising:

a photoreceptor;

a charging member configured to charge the photoreceptor;

a power supply configured to supply direct current (DC) power and alternating current (AC) power to the charging member, and perform a charging operation by provide charging power to the charging member to charge the photoreceptor;

a measurement unit configured to measure a current provided by the power supply to the charging member; and a controller configured to determine a current saturation point of the charging member using the current value measured by the measurement unit in a state in which the power supply is supplying fixed DC power and varied AC power to the charging member, and control the power supply to perform the charging operation with only DC power corresponding to the determined current saturation point.

2. The image forming apparatus as claimed in claim 1, wherein the power supply includes:

a DC power supply configured to generate DC power; and an AC power supply configured to generate AC power, overlap the generated AC power with the DC power generated by the DC power supply, and provide the overlapped DC power and AC power to the charging member, and the measurement unit includes:

a first measurement unit configured to measure a first output current output from the DC power supply; and a second measurement unit configured to measure a second output current from the AC power supply.

3. The image forming apparatus as claimed in claim 2, wherein the controller determines a saturation point of the first output current using the first output current value measured by the first measurement unit, and calculates the current saturation point of the charging member corresponding to the determined saturation point of the first output current.

4. The image forming apparatus as claimed in claim 2, wherein the controller controls the power supply to output the varied AC power in a state in which the fixed DC power is corresponding to a predetermined surface potential and is being output, and determines a saturation point of the output current.

5. The image forming apparatus as claimed in claim 4, wherein the controller controls the AC power supply to obtain the varied AC power by varying AC power in unit of a preset magnitude and to output the varied AC power.

6. The image forming apparatus as claimed in claim 4, wherein the controller:

controls the AC power supply to output three pieces of AC power each having a different magnitude, creates a relational expression between AC power and a measured current based on two of the three pieces of AC power each having a different magnitude and current values measured in the two pieces of AC power, and determines a saturation point of the output current based on the generated relational expression and a current value regarding the remaining AC power.

7. The image forming apparatus as claimed in claim 2, wherein the AC power supply generates square wave AC power of about 3 KHz.

8. The image forming apparatus as claimed in claim 2, wherein the controller controls the power supply to vary a magnitude of DC power in a state in which AC power is not output, and determines a magnitude of DC power, under which the second output current value measured by the second measurement unit and the current saturation point of the charging member are equal, as a charging voltage.

9. The image forming apparatus as claimed in claim 1, wherein when a target surface potential is varied, the controller calculates a current saturation point corresponding to the target surface potential by using a previously stored relational expression between input DC power input to the charging member and a surface potential of the photoreceptor.

10. The image forming apparatus as claimed in claim 9, wherein the controller controls the power supply to sequentially provide pieces of DC power each having a different magnitude to the charging member in a state in which AC power having a preset magnitude is maintained, and generates and stores a relational expression between input DC power and the surface potential by using a current value measured when the pieces of DC power each having a different magnitude are supplied.

11. A method for controlling charging of an image forming apparatus, the method comprising:

supplying fixed direct current (DC) power and varied alternating current (AC) power to a charging member;

measuring a current provided to the charging member;

determining a current saturation point of the charging member using the measured current value; and performing a charging operation by supplying only DC power, corresponding to the determined current saturation point, to the charging member.

12. The method as claimed in claim 11, wherein, in the determining the current saturation point of the charging member, a saturation point of an output current is determined using an output current value measured by a first measurement unit measuring an output current of a DC power supply, and a current saturation point of the charging member corresponding to the determined saturation point of the output current is calculated.

13. The method as claimed in claim 11, wherein, in the supplying, the varied AC power is output in a state in which the fixed DC power is corresponding to a predetermined surface potential and is being output.

14. The method as claimed in claim 13, wherein, in the supplying, AC power is varied in unit of a preset magnitude and the varied AC power is output.

15. The method as claimed in claim 13, wherein, in the supplying, three pieces of AC power each having a different magnitude are output, and in the determining the current saturation point of the charging member, a relational expression between AC power and a measured current is created based on two of the three pieces of AC power each having a different magnitude and current values measured in the two pieces of AC power, and a saturation point of an output current is determined based on the generated relational expression and a current value regarding the remaining AC power.

16. The method as claimed in claim 11, further comprising:

varying a magnitude of DC power in a state in which AC power is not output; and determining a magnitude of DC power, for which the measured output current value and the current saturation point of the charging member are equal, as a charging voltage.

17. The method as claimed in claim 11, wherein, in the determining the current saturation point of the charging member, when a target surface potential is varied, a current saturation point corresponding to the target surface potential is calculated by using a relational expression between previously stored input DC power and a surface potential.

18. The method as claimed in claim 17, further comprising:

sequentially providing pieces of DC power each having a different magnitude in a state in which AC power having a preset magnitude is maintained; and generating and storing a relational expression between input DC power and the surface potential by using a current value measured when the pieces of DC power each having a different magnitude are supplied.

19. An image forming apparatus comprising:

a photoreceptor;

a charging member configured to charge the photoreceptor;

a power supply configured to supply direct current (DC) power and alternating current (AC) power to the charging member and perform a charging operation by providing a DC charging current to the charging member to charge the photoreceptor;

a measurement unit configured to measure a current provided by the power supply to the charging member; and a controller configured to perform a method of determining a current saturation point of the charging member comprising:

controlling the power supply to supply the DC power at a fixed voltage to the charging member, and, concurrently, controlling the power supply to supply the AC power at a plurality of different peak-to-peak voltages, and determining the current saturation point of the charging member based on observing a relation between the different peak-to-peak voltages and measurements of the current, obtained by the measurement unit, under the different peak-to-peak voltages.

20. The image forming apparatus of claim 19, wherein in the controlling the power supply to supply the AC power, a peak-to-peak voltage of the supplied AC power is increased until the current is determined by the controller as having saturated at a saturation current, and the determining the current saturation point is based on the saturation current.

* * * * *